US010088771B1

(12) United States Patent
Kuramoto

(10) Patent No.: US 10,088,771 B1
(45) Date of Patent: Oct. 2, 2018

(54) DEVELOPING DEVICE AND IMAGE FORMING APPARATUS

(71) Applicant: FUJI XEROX CO., LTD., Tokyo (JP)

(72) Inventor: Shinichi Kuramoto, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/814,414

(22) Filed: Nov. 16, 2017

(30) Foreign Application Priority Data

Jun. 14, 2017 (JP) ..... 2017-116570

(51) Int. Cl.
*G03G 15/08* (2006.01)
*G03G 9/107* (2006.01)
*G03G 15/16* (2006.01)

(52) U.S. Cl.
CPC ..... *G03G 15/0808* (2013.01); *G03G 9/107* (2013.01); *G03G 15/0889* (2013.01); *G03G 15/1605* (2013.01)

(58) Field of Classification Search
CPC ..... G03G 15/0808; G03G 15/0889
See application file for complete search history.

(56) References Cited

U.S. PATENT DOCUMENTS

2015/0016848 A1* 1/2015 Ishii ..... G03G 15/0896 399/279
2015/0093139 A1* 4/2015 Kuramoto ..... G03G 15/0806 399/92
2016/0306291 A1* 10/2016 Kuroda ..... G03G 15/0844

FOREIGN PATENT DOCUMENTS

JP 2005-346035 12/2005
JP 2008-039965 2/2008

* cited by examiner

*Primary Examiner* — Gregory H Curran
(74) *Attorney, Agent, or Firm* — JCIPRNET

(57) ABSTRACT

A developing device includes a storage container that stores a developer, a developer carrier that holds a developer and rotates to develop an image held on an image carrier, a transporting member that transports a developer, an outlet flow path that allows air inside the storage container to be discharged therethrough, and a partition disposed between an air inlet of the outlet flow path and the developer carrier, the partition having an end located at a level of or below a lower end of the developer carrier in a direction of gravity and above an upper end of the transporting member in the direction of gravity.

6 Claims, 5 Drawing Sheets

DEVELOPING DEVICE AND IMAGE FORMING APPARATUS

CROSS-REFERENCE TO RELATED APPLICATIONS

This application is based on and claims priority under 35 USC 119 from Japanese Patent Application No. 2017-116570 filed Jun. 14, 2017.

BACKGROUND

Technical Field

The present invention relates to a developing device and an image forming apparatus.

SUMMARY

According to an aspect of the invention, a developing device includes a storage container that stores a developer, a developer carrier that holds a developer and rotates to develop an image held on an image carrier, a transporting member that transports a developer, an outlet flow path that allows air inside the storage container to be discharged therethrough, and a partition disposed between an air inlet of the outlet flow path and the developer carrier, the partition having an end located at a level of or below a lower end of the developer carrier in a direction of gravity and above an upper end of the transporting member in the direction of gravity.

BRIEF DESCRIPTION OF THE DRAWINGS

Exemplary embodiments of the present invention will be described in detail based on the following figures, wherein.

DETAILED DESCRIPTION

Exemplary embodiments of the present invention are described below with reference to the drawings. The exemplary embodiments described below merely illustrate a developing device and an image forming apparatus for embodying the technical idea of the present invention, and are not intended to limit the present invention to these exemplary embodiments. The present invention is also equally applicable to other exemplary embodiments included in the scope of claims.

Figure 1:
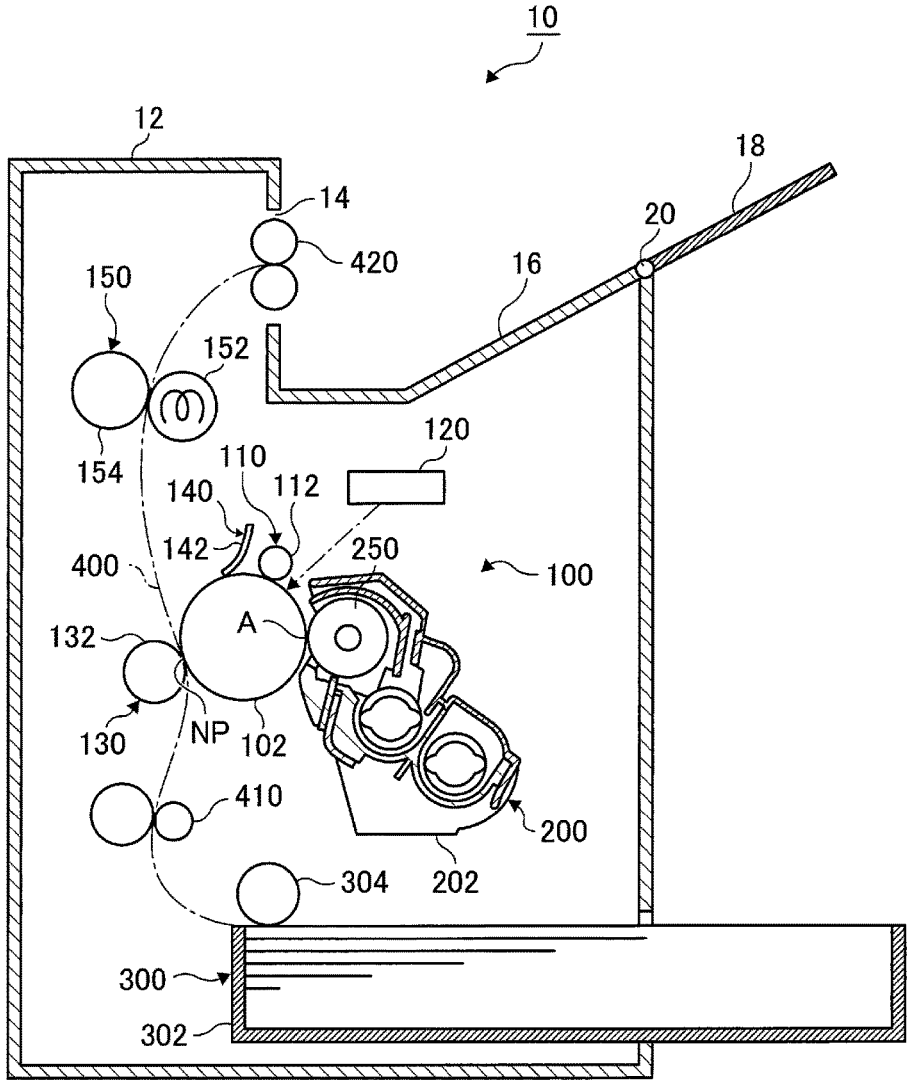
FIG. 1 illustrates a schematic structure of an image forming apparatus according to an exemplary embodiment of the present invention.

FIG. 1 illustrates an image forming apparatus 10 according to an exemplary embodiment of the present invention. As illustrated in FIG. 1, the image forming apparatus 10 includes an image forming apparatus body 12. The image forming apparatus body 12 holds, inside itself, an image forming portion 100 and a feeding device 300, which feeds a recording medium such as a sheet. The image forming apparatus body 12 also holds, inside itself, a transport path 400, along which a recording medium is transported.

The image forming apparatus body 12 has an outlet 14, from which a recording medium is discharged. The image forming apparatus body 12 has an upper surface used as a discharge portion 16. The discharge portion 16 receives recording media discharged from the inside of the image forming apparatus body 12 through the outlet 14. The image forming apparatus body 12 has a support plate 18 attached thereto.

Together with the discharge portion 16, the support plate 18 supports the recording medium discharged from the inside of the image forming apparatus body 12. The support plate 18 is attached to the image forming apparatus body 12 so as to be rotatable around a hinge 20.

The image forming portion 100 forms, for example, monochrome images and is, for example, an electrophotographic device. The image forming portion 100 includes a photoconductor drum 102, which is an example of an image carrier that carries an image, a charging device 110, which charges the photoconductor drum 102, and a latent image forming device 120, which irradiates a surface of the photoconductor drum 102 charged by the charging device 110 with light to form an electrostatic latent image on the surface of the photoconductor drum 102, a developing device 200, which develops the latent image formed on the photoconductor drum 102 with a developer containing toner to form a toner image on the surface of the photoconductor drum 102, a transfer device 130, which transfers the toner image formed on the surface of the photoconductor drum 102 by the developing device 200 to a recording medium, a cleaning device 140, which cleans the photoconductor drum 102 from which the toner image has been transferred to the recording medium by the transfer device 130, and a fixing device 150, which fixes the toner image transferred to the recording medium by the transfer device 130 onto the recording medium.

The charging device 110 includes a charging member 112. The charging member 112 is, for example, a roller and is disposed in contact with or adjacent to the photoconductor drum 102. A power source, not illustrated, applies a charging voltage of a direct current or a charging voltage of an alternating current superimposed onto a direct current to the photoconductor drum 102 to charge the photoconductor drum 102.

The developing device 200 is, for example, a so-called binary development device that develops a latent image using a developer containing a mixture of toner and a carrier. An example used here is a developer obtained by mixing a negatively charged nonmagnetic toner and a positively charged magnetic carrier. The developing device 200 includes a developing device body 202, which is an example of a storage container that holds a developer, and a toner moving mechanism 250, which is a mechanism for transferring toner in the developer held in the developing device body 202 to the photoconductor drum 102. The developing device 200 is described in detail, below.

The transfer device 130 includes a transfer member 132. The transfer member 132 is, for example, a roller and disposed, for example, in contact with the photoconductor drum 102. A power source not illustrated applies a transfer voltage to the transfer member 132.

The cleaning device 140 includes a cleaning member 142. The cleaning member 142 is, for example, a plate-shaped member, and has one end pressed against the photoconductor drum 102. The pressed end removes a developer or other objects from the surface of the photoconductor drum 102 to clean the photoconductor drum 102.

The fixing device 150 includes a heating roller 152, which has a heater inside, and a pressing roller 154, which is in contact with the heating roller 152. The heating roller 152 and the pressing roller 154 heat and press a toner image transferred to a recording medium at a contact portion, at which the heating roller 152 and the pressing roller 154 are in contact with each other, to fix the toner image onto the recording medium.

The feeding device 300 feeds a recording medium toward the image forming portion 100. The feeding device 300 includes a storage container 302, which stores a stack of recording media, and a pick-up roller 304, which picks up recording media from the storage container 302.

The transport path 400 allows a recording medium to be transported along itself from the feeding device 300 toward the transfer device 130, to be transported along itself from the transfer device 130 toward the fixing device 150, and to be discharged from the inside of the image forming apparatus body 12. Around and along the transport path 400 in order from the upstream side in a direction in which the recording medium is transported, the pick-up roller 304, a registration roller 410, the transfer device 130 and the photoconductor drum 102, the fixing device 150, and a discharging roller 420 are disposed.

The registration roller 410 temporarily stops the leading end of a recording medium transported toward a nip portion NP, at which the photoconductor drum 102 and the transfer member 132 come into contact with each other. The registration roller 410 causes the leading end of the recording medium to move again toward the nip portion NP at a timing at which an image is formed with toner on the photoconductor drum 102.

The discharging roller 420 discharges a recording medium to which a toner image has been fixed by the fixing device 150 to the outside of the image forming apparatus body 12.

An area A in FIG. 1 is a fed area of the photoconductor drum 102 to which a developer is fed from a development sleeve 260 (see FIG. 2) described below.

Figure 2:
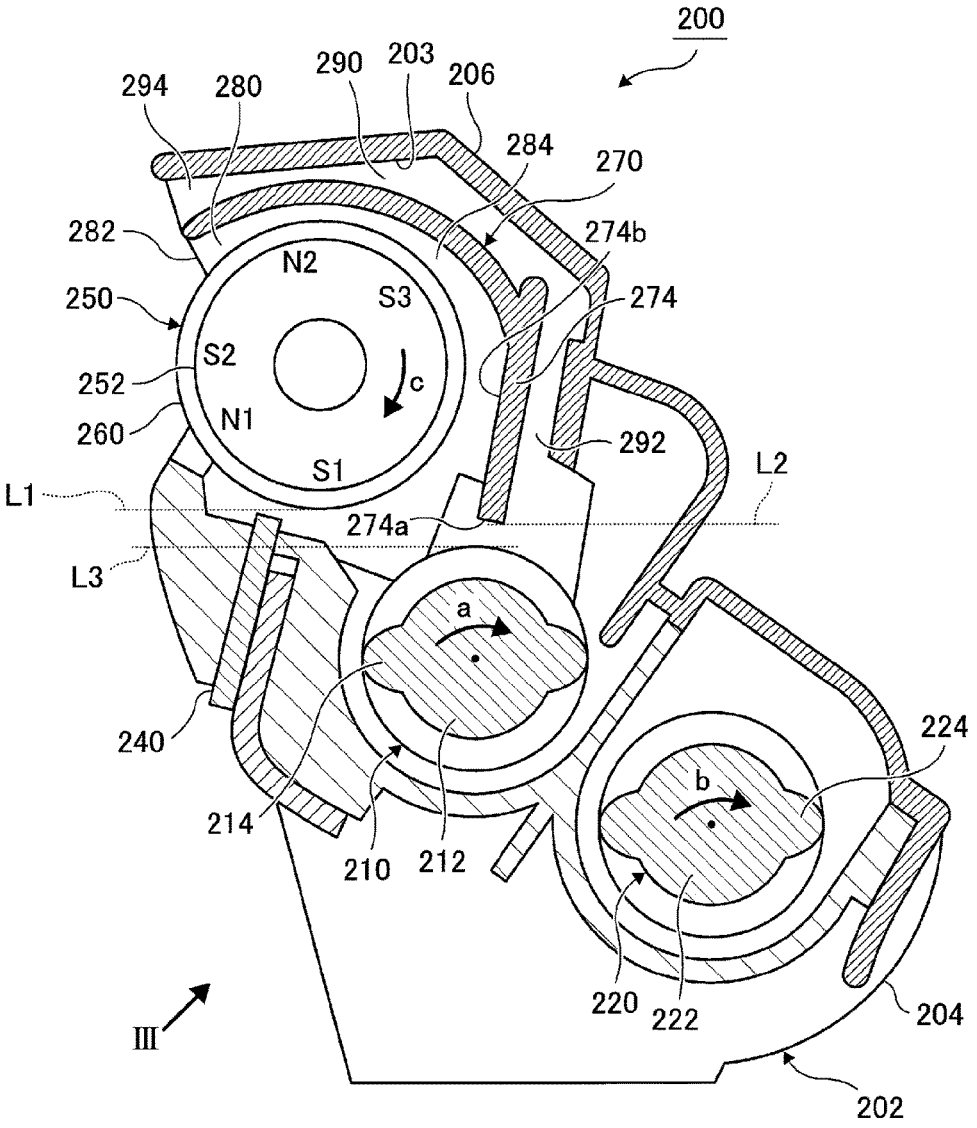
FIG. 2 illustrates a schematic structure of a first example of a developing device of the image forming apparatus illustrated in FIG. 1.
Figure 3:
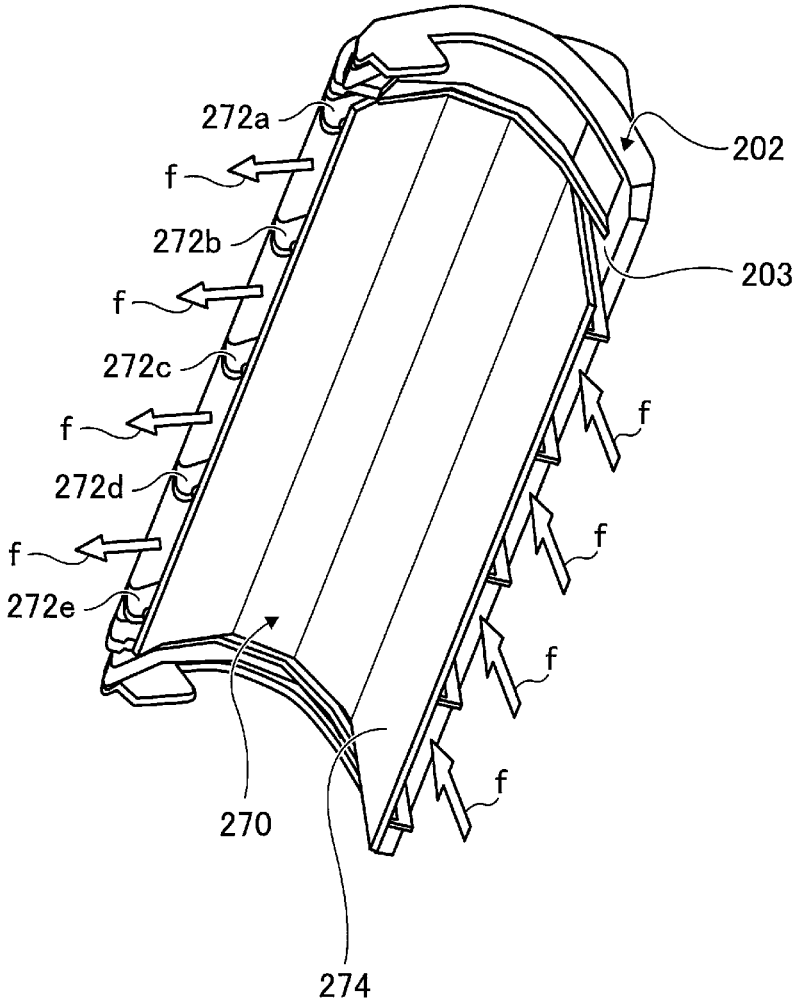
FIG. 3 is a perspective view of a portion of the developing device illustrated in FIG. 2, viewed in the direction of arrow III in FIG. 2.

FIGS. 2 and 3 illustrate a first example of the developing device 200. As described above, the developing device 200 includes a developing device body 202 and a toner moving mechanism 250. As illustrated in FIG. 2, the toner moving mechanism 250 includes a magnet member 252, having multiple magnetic poles, and a development sleeve 260. The development sleeve 260 is an example of a developer carrier. The development sleeve 260 holds a developer and rotates to develop an electrostatic latent image held on the photoconductor drum 102 with the developer. The magnet member 252 and the development sleeve 260 are described below in detail.

The developing device body 202 includes a lower body 204, disposed on the lower side, and a cover member 206, attached to the lower body 204 so as to cover an opening at an upper portion of the lower body 204. For example, the cover member 206 of the developing device body 202 has a feeding opening (not illustrated) to connect the outer side to the inner side of the developing device body 202. Through the feeding opening, toner is fed from a toner storage container (not illustrated) into the developing device body 202.

The developing device 200 also includes a thickness restricting member 240, which restricts the thickness of the developer attracted to the surface of the development sleeve 260. The thickness restricting member 240 is attached to the developing device body 202 to define a predetermined gap between the development sleeve 260 and its end closer to the development sleeve 260.

The developing device 200 also includes a transporting member 210. The transporting member 210 is an example of a transporting member that rotates inside a storage container to transport a developer. The transporting member 210 transports a developer and agitates the developer. The transporting member 210 includes a shaft 212 and a blade 214 helically extending on the outer circumferential surface of the shaft 212. The shaft 212 and the blade 214 are integrated together and rotate in the direction of arrow a in FIG. 2. The blade 214 agitates the developer inside the developing device body 202 in such a manner as to press the developer to transport the developer. More specifically, the transporting member 210 transports the developer in the longitudinal direction of the transporting member 210 (direction perpendicular to the plane of FIG. 2) and toward the toner moving mechanism 250 (from right to left in FIG. 2).

The developing device 200 also includes a transporting member 220. The transporting member 220 includes a shaft 222 and a blade 224, helically extending on the outer circumferential surface of the shaft 222. The shaft 222 and the blade 224 are integrated together and rotate in the direction of arrow b in FIG. 2. The blade 224 agitates the developer inside the developing device body 202 in such a manner as to press the developer to transport the developer. More specifically, the transporting member 220 transports the developer in the longitudinal direction of the transporting member 220.

As described above, the transporting member 220 and the transporting member 210 agitate and transport the developer inside the developing device body 202, so that the toner in the developer is rubbed with, for example, the carrier and thus charged by the friction with the carrier or other objects.

The development sleeve 260 feeds a developer to the photoconductor drum 102 in the fed area A (see FIG. 1) to cause the toner in the developer to electrostatically adhere to the photoconductor drum 102. The development sleeve 260 is made of a nonmagnetic material and has, for example, a cylindrical shape. The development sleeve 260 is connected to, for example, a motor (not illustrated) used as a driving source with a driving transmission mechanism (not illustrated) including, for example, a gear train interposed therebetween. The development sleeve 260 rotates in the direction of arrow c illustrated in FIG. 2 as a result of the driving force from the motor or the like being transmitted to the development sleeve 260 via the driving transmission mechanism.

The development sleeve 260 has a diameter of, for example, smaller than or equal to 25 mm. The developing device 200 including the development sleeve 260 having a diameter of smaller than or equal to 25 mm is made smaller than a device including the development sleeve 260 having a diameter of greater than 25 mm. During development, the development sleeve 260 rotates at a speed of, for example, higher than or equal to 600 revolutions per minute. The development sleeve 260 that rotates at a speed of higher than or equal to 600 revolutions per minute during development is capable of feeding a larger amount of the developer to the photoconductor drum 102 than the device including the development sleeve 260 that rotates at a speed of, for example, smaller than 600 revolutions per minute during development.

The magnet member 252 has a solid cylindrical shape and has multiple magnetic poles extending in the longitudinal direction of the magnet member 252. More specifically, the magnet member 252 includes five magnetic poles, for example, an attraction magnetic pole S1, a transport magnetic pole N1, a development magnetic pole S2, a transport magnetic pole N2, and a separation magnetic pole S3.

The attraction magnetic pole S1 is used to attract the developer transported by the transporting member 210 toward the development sleeve 260 to the surface of the development sleeve 260. Here, the thickness restricting member 240 is disposed to have its end closer to the development sleeve 260 located within the range over which the magnetic force of the attraction magnetic pole S1 is exerted. Thus, the developer that has been attracted to the development sleeve 260 by the magnetic force of the attraction magnetic pole S1 and that has failed to pass through the gap between the development sleeve 260 and the thickness restricting member 240 is separated from the surface of the development sleeve 260 by the thickness restricting member 240 to restrict the thickness of the developer attracted to the development sleeve 260.

The transport magnetic pole N1 is disposed downstream of the attraction magnetic pole S1 in the rotation direction of the development sleeve 260. The transport magnetic pole N1 keeps the developer attracted to the surface of the development sleeve 260 to transport the developer with the rotation of the development sleeve 260.

The development magnetic pole S2 is disposed downstream of the transport magnetic pole N1 in the rotation direction of the development sleeve 260. The development magnetic pole S2 is disposed near a transfer area in which the toner transfers from the surface of the development sleeve 260 to the photoconductor drum 102 (see FIG. 1) to develop an electrostatic latent image formed on the surface of the photoconductor drum 102 with toner.

The transport magnetic pole N2 is disposed downstream of the development magnetic pole S2 in the rotation direction of the development sleeve 260. Similarly to the above-described transport magnetic pole N1, the transport magnetic pole N2 keeps the developer attracted to the surface of the development sleeve 260 to transport the developer with the rotation of the development sleeve 260.

The separation magnetic pole S3 is disposed downstream of the transport magnetic pole N2 in the rotation direction of the development sleeve 260 to separate the developer from the surface of the development sleeve 260.

The developing device 200 also includes an inlet flow path 280, an outlet flow path 290, and a flow-path forming member 270, which defines the inlet flow path 280 and the outlet flow path 290.

As illustrated in FIG. 3, the flow-path forming member 270 is attached to an inner wall 203 using, for example, five support members 272*a*, 272*b*, 272*c*, 272*d*, and 272*e* to define a space between the flow-path forming member 270 and the inner wall 203 of the developing device body 202. This space is used as the outlet flow path 290 illustrated in FIG. 2. Arrows f in FIG. 3 schematically indicate the air flow discharged from the inside to the outside of the developing device body 202 through the outlet flow path 290.

The flow-path forming member 270 is disposed between the inner wall 203 and the development sleeve 260. The space between the development sleeve 260 and the flow-path forming member 270 is used as the inlet flow path 280.

The inlet flow path 280 has an inlet 282, into which air flows. The inlet 282 is disposed downstream of the fed area A (see FIG. 1), to which the developer is fed from the development sleeve 260 to the photoconductor drum 102 (see FIG. 1), in the rotation direction of the development sleeve 260 indicated with arrow c. The inlet flow path 280 has an air outlet 284 disposed inside the developing device body 202. Accompanying the rotation of the development sleeve 260 in the direction of arrow c, air flows into the inlet flow path 280 from the inlet 282. The air that has flowed into the inlet flow path 280 passes through the air outlet 284 and flows into the developing device body 202.

When the air flows into the developing device body 202, the atmospheric pressure inside the developing device body 202 rises. The atmospheric pressure rises more significantly as the revolutions per minute of the development sleeve 260 increase in response to, for example, an increase of the speed at which the image forming apparatus 10 forms images.

The outlet flow path 290 is an example of an outlet flow path for discharging air inside the developing device body 202. The outlet flow path 290 connects the space inside the developing device body 202 to the space outside the developing device body 202. The outlet flow path 290 is thus disposed to connect the space inside the developing device body 202 to the space outside the developing device body 202, so that the atmospheric pressure inside the developing device body 202 is prevented from rising accompanying, for example, a rotation of the development sleeve 260.

The outlet flow path 290 allows air in the developing device body 202 to flow in from an air inlet 292 disposed inside the developing device body 202 and to flow out of the developing device body 202 through an air outlet 294.

The air outlet 294 is disposed near the inlet 282 of the inlet flow path 280. More specifically, the air outlet 294 is disposed adjacent to the inlet 282 with a second end of the flow-path forming member 270 interposed therebetween.

In the developing device 200 having the above-described structure, toner contained in the developer may scatter inside the developing device body 202 and the scattered toner may leak out of the developing device body 202 through the outlet flow path 290. If the toner leaks out of the developing device body 202, the image forming apparatus body 12 may have its inside stained with the leaked toner, and the recording medium inside the image forming apparatus body 12 may be stained with the toner. Here, the amount of toner of the developer that leaks out from the developing device body 202 increases as the amount of the developer located near the air inlet 292, such as the developer attached to the air inlet 292 of the outlet flow path 290, increases. When the toner accumulates in the outlet flow path 290, the pressure inside the developing device body 202 rises, and dust such as toner that goes out of the developing device body 202 increases.

In the developing device 200 having the above structure, the development sleeve 260, rotating at a high speed of higher than or equal to, for example, 600 revolutions per minute may cause the centrifugal force that separates the developer from the development sleeve 260, and the developer that has separated from the development sleeve 260 may rapidly flow into the space inside the developing device body 202. The developer that has flowed into the space inside the developing device body 202 may adhere to the air inlet 292 of the outlet flow path 290.

The developer that has flowed into the space inside the developing device body 202 may collide with the inner wall 203 of the developing device body 202 or the flow-path forming member 270. The developer that has collided with the inner wall 203 of the developing device body 202 or the flow-path forming member 270 may cause the toner to scatter inside the developing device body 202.

The image forming apparatus 10 has a unique mechanism to reduce the amount of a developer located near the air inlet 292, such as the developer adhering to the air inlet 292 of the outlet flow path 290, and to reduce the amount of toner discharged from the developing device body 202 through the outlet flow path 290 even when toner scatters inside the developing device body 202. Specifically, the developing device 200 includes a partition 274 to reduce the amount of toner discharged from the developing device body 202 through the outlet flow path 290 using the partition 274. The partition 274 is described specifically.

As illustrated in FIG. 2, the partition 274 is disposed between the air inlet 292 of the outlet flow path 290 and the development sleeve 260. At least part of the flow-path forming member 270 also serves as the partition 274. Specifically, the partition 274 forms at least part of the outlet flow path 290 between the partition 274 and the developing device body 202.

As described above, the partition 274 is disposed to form at least part of the outlet flow path 290. The developing device 200 has a simpler structure than the structure where the entirety of the outlet flow path 290 is formed of a component separate from that of the partition 274. Specifically, the developing device 200 is constituted of fewer components than the structure where the entirety of the outlet flow path 290 is formed of a component separate from that of the partition 274. Instead of the partition 274 forming at least part of the outlet flow path 290, the entirety of the outlet flow path 290 may be formed of a component separate from the partition 274.

An end 274*a* of the partition 274 is located at a level of or below the lower end of the development sleeve 260 in the direction of gravity and above the upper end of the transporting member 210 in the direction of gravity. A line segment L1 in FIG. 2 is a horizontal line segment drawn to pass the lower end of the development sleeve 260. A line segment L2 in FIG. 2 is a horizontal line segment drawn to pass the end 274*a*. A line segment L3 in FIG. 2 is a horizontal line segment drawn to pass the upper end of the transporting member 210.

As described above, the end 274*a* of the partition 274 is located at the level of or below the lower end of the development sleeve 260 in the direction of gravity. Compared to the structure where the end 274*a* of the partition 274 is located above the lower end of the development sleeve 260 in the direction of gravity, this structure hinders toner contained in the developer separated from the development sleeve 260 and floating inside the developing device body 202 from accessing the air outlet 294 to reduce the amount of toner passing through the air inlet 292 and discharged from the developing device body 202.

As described above, the end 274*a* of the partition 274 is located above the upper end of the transporting member 210 in the direction of gravity. This structure allows the transporting member 210 to more smoothly transport the developer toward the development sleeve 260 than the structure in which the end 274*a* of the partition 274 is located at the same level as or below the upper end of the transporting member 210 in the direction of gravity.

The partition 274 includes a guide surface 274*b*. The guide surface 274*b* is an example of a guide surface that guides the developer separated from the development sleeve 260 toward the transporting member 210. The guide surface 274*b* is a surface facing the development sleeve 260. The guide surface 274*b* is, for example, flat. The guide surface 274*b* is, for example, inclined to have its lower portion (portion closer to the end 274*a*) located closer to the development sleeve 260 than are other portions.

Figure 4:
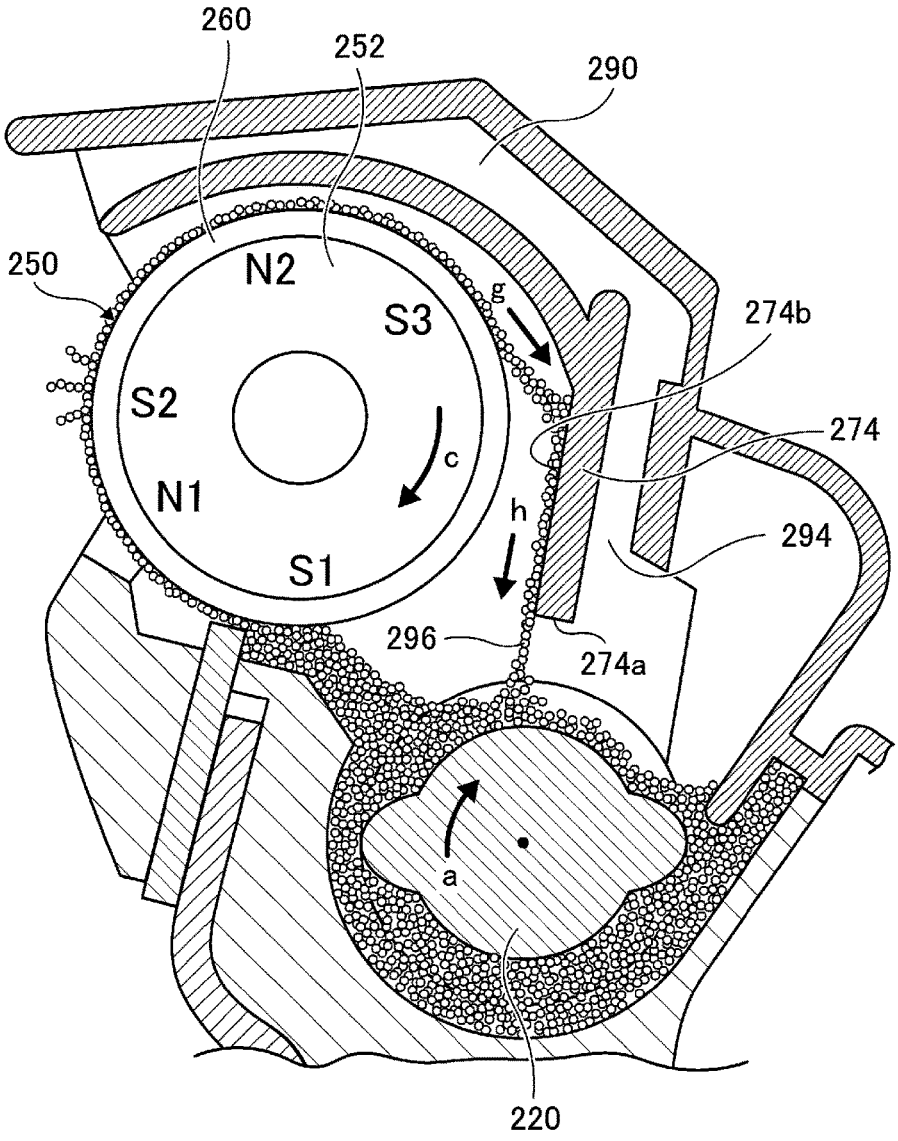
FIG. 4 describes a movement of a developer inside the developing device illustrated in FIG. 2.

FIG. 4 describes a movement of the developer inside the developing device 200. As illustrated in FIG. 4, the developer separated from the development sleeve 260 near the separation magnetic pole S3 is caused by the centrifugal force resulting from the rotation of the development sleeve 260 to jump to the guide surface 274*b*, as indicated with arrow g, and collide with the guide surface 274*b*. When the developer collides with the guide surface 274*b*, part of toner in the developer is separated from the carrier in the developer, and the part of toner in the developer separated from the carrier in the developer floats inside the developing device body 202.

The developer that has collided with the guide surface 274*b* is guided by the guide surface 274*b* toward the transporting member 220 as indicated with arrow h.

The developer guided to the vicinity of the transporting member 220 is transported toward the development sleeve 260 by the rotation of the transporting member 220 in the direction of arrow a.

Here, the developer that has separated from the end 274*a* of the partition 274 forms a film portion 296 of the developer between itself and the developer located above the transporting member 220. The film portion 296 hinders toner floating inside the developing device body 202 at a portion closer to the development sleeve 260 than the film portion 296 from moving toward the air outlet 294 of the outlet flow path 290 from the film portion 296 in the developing device body 202. This structure is capable of reducing the amount of toner discharged to the outside of the developing device body 202 through the outlet flow path 290, compared to the technique with which the developer does not form the film portion 296.

Figure 5:
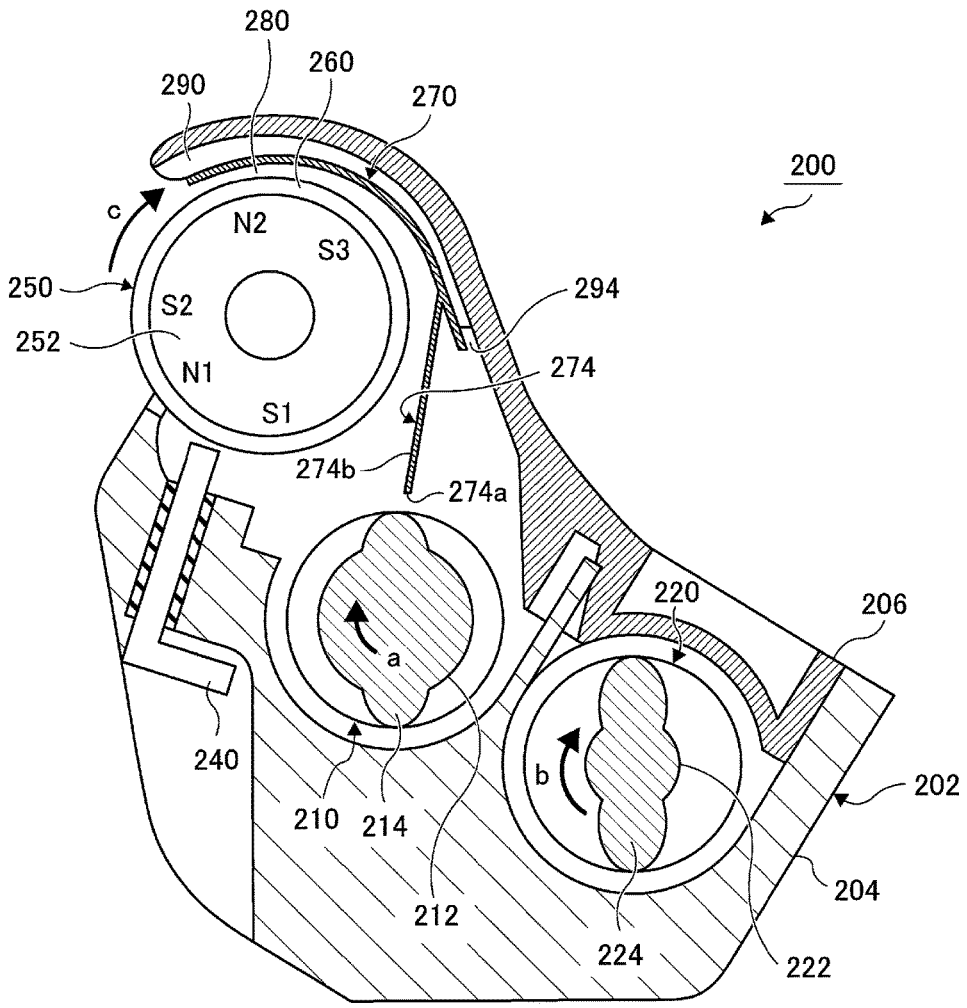
FIG. 5 illustrates a second example of a developing device of the image forming apparatus illustrated in FIG. 1.

FIG. 5 illustrates a second example of the developing device 200. In the above-described first example, the partition 274 forms a portion of the outlet flow path 290 (see FIG. 2). In the second example, in contrast, the partition 274 protrudes from the surface of the flow-path forming member 270 facing the development sleeve 260.

The exemplary embodiments are described using, as an example, a structure in which the image forming portion 100 forms monochrome images. However, the image forming portion 100 may form multicolor images.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A developing device comprising:

a storage container that stores a developer;

a developer carrier that holds a developer and rotates to develop an image held on an image carrier;

a transporting member that transports a developer;

an outlet flow path that allows air inside the storage container to be discharged therethrough; and a partition disposed between an air inlet of the outlet flow path and the developer carrier, the partition having an end located at a level of or below a lower end of the developer carrier in a direction of gravity and above an upper end of the transporting member in the direction of gravity.

2. The developing device according to claim 1, wherein the partition forms at least a part of the outlet flow path between the partition and the storage container.

3. The developing device according to claim 1, wherein the partition has a guide surface that guides a developer that has separated from the developer carrier toward the transporting member.

4. The developing device according to claim 1, wherein a developer that has separated from the end of the partition forms a film portion that restricts movement of a developer scattering in the storage container.

5. The developing device according to claim 1, wherein the developer carrier has a diameter of smaller than or equal to 25 mm, and wherein the developer carrier rotates at a speed higher than or equal to 600 revolutions per minute.

6. An image forming apparatus, comprising:

an image carrier that holds an image;

a storage container that stores a developer;

a developer carrier that holds a developer and rotates to develop an image held on the image carrier;

a transporting member that transports a developer;

an outlet flow path that allows air inside the storage container to be discharged therethrough; and a partition disposed between an air inlet of the outlet flow path and the developer carrier, the partition having an end located at a level of or below a lower end of the developer carrier in a direction of gravity and above an upper end of the transporting member in the direction of gravity.

* * * * *